US005674581A

United States Patent [19]

Marco et al.

[11] Patent Number: 5,674,581

[45] Date of Patent: Oct. 7, 1997

[54] TEXTILE FABRIC HAVING A THERMALLY MODIFIED NARROW CHANNEL TO FACILITATE SEPARATION

[75] Inventors: Francis William Marco, Pauline; Colman Barrett O'Connell, Inman; Howard Christy Willauer, Jr.; James Ansel Jacobs, Jr., both of Spartanburg, all of S.C.

[73] Assignee: Milliken Research Corporation, Spartanburg, S.C.

[21] Appl. No.: 632,122

[22] Filed: Apr. 15, 1996

Related U.S. Application Data

[63] Continuation of Ser. No. 512,610, Aug. 8, 1995, abandoned, which is a continuation of Ser. No. 189,275, Jan. 31, 1994, abandoned, which is a continuation of Ser. No. 998,262, Dec. 29, 1992, abandoned, which is a division of Ser. No. 550,428, Jul. 10, 1990, Pat. No. 5,202,077.

[51] Int. Cl.[6] ..... D03D 3/00

[52] U.S. Cl. ..... 428/43; 428/167; 428/171; 442/109

[58] Field of Search ..... 428/43, 167, 171, 428/172, 173, 132, 138; 442/109

[56] References Cited

U.S. PATENT DOCUMENTS

| | | | |
|---|---|---|---|
| 1,603,723 | 10/1926 | Stetten . | |
| 1,889,902 | 12/1932 | Moore . | |
| 1,970,633 | 8/1934 | Springer | 428/43 |
| 2,110,118 | 3/1938 | Robertson et al. | 26/29 |
| 2,119,057 | 5/1938 | Richa | 222/51 |
| 2,241,222 | 5/1941 | Sonnino | 26/2 |
| 2,563,259 | 8/1951 | Miller | 117/9 |
| 2,723,937 | 11/1955 | Rice | 154/106 |
| 2,875,504 | 3/1959 | White | 28/72 |
| 2,988,800 | 6/1961 | White | 28/72 |
| 3,010,179 | 11/1961 | Thal | 28/72 |
| 3,153,106 | 10/1964 | Schlick | 264/78 |
| 3,171,484 | 3/1965 | Thal | 161/63 |
| 3,214,819 | 11/1965 | Guerin et al. | 28/72.2 |
| 3,256,581 | 6/1966 | Thal et al. | 26/2 |
| 3,353,225 | 11/1967 | Dodson, Jr. et al. | 19/161 |
| 3,357,074 | 12/1967 | Allman et al. | 28/1 |
| 3,403,862 | 10/1968 | Dworjanyn | 239/566 |
| 3,434,188 | 3/1969 | Summers | 28/72.2 |
| 3,443,878 | 5/1969 | Weber et al. | 8/14 |
| 3,448,501 | 6/1969 | Buzano | 28/72 |

(List continued on next page.)

FOREIGN PATENT DOCUMENTS

| | | |
|---|---|---|
| 233019 | 2/1968 | Australia . |
| 766310 | 4/1971 | Belgium . |
| 653805 | 1/1968 | Canada . |
| 2 056 210 | 2/1972 | Germany . |
| 3 613 070 | 10/1987 | Germany . |
| 851473 | 1/1966 | United Kingdom . |
| 978452 | 6/1967 | United Kingdom . |
| 1101899 | 1/1968 | United Kingdom . |
| 1012963 | 2/1968 | United Kingdom . |
| 1171543 | 11/1968 | United Kingdom . |
| 1172289 | 11/1968 | United Kingdom . |
| 1321236 | 2/1973 | United Kingdom . |
| 1353183 | 2/1974 | United Kingdom . |
| 2 088 424 | 6/1982 | United Kingdom . |

*Primary Examiner*—Kathleen Choi
*Attorney, Agent, or Firm*—Terry T. Moyer; George M. Fisher

[57] ABSTRACT

A method and apparatus for treatment of relatively moving substrate materials and the novel products produced thereby created by precise application of high temperature pressurized streams of fluid against the surface of the materials to melt and remove material which imparts a recessed channel to the materials that facilitates separation of the materials. The apparatus includes an elongate manifold for receiving heated pressurized fluid, such as air, disposed across the width of the relatively moving material and having a single slit the full width of the substrate for directing the fluid into the surface of the material. The substrate material is treated with an acrylic resin to eliminate jagged or frayed edges either prior to or after the melting and removal process by means of the high temperature pressurized fluid streams.

1 Claim, 5 Drawing Sheets

U.S. PATENT DOCUMENTS

| | | | |
|---|---|---|---|
| 3,452,412 | 7/1969 | Allman, Jr. et al. | 28/72 |
| 3,458,905 | 8/1969 | Dodson, Jr. et al. | 19/161 |
| 3,494,821 | 2/1970 | Evans | 161/169 |
| 3,508,308 | 4/1970 | Bunting, Jr. et al. | 28/72.2 |
| 3,585,098 | 6/1971 | Truscott et al. | 161/63 |
| 3,613,186 | 10/1971 | Mazzone et al. | 26/2 R |
| 3,635,625 | 1/1972 | Voss | 425/135 |
| 3,729,784 | 5/1973 | Mazzone et al. | 26/2 R |
| 3,750,237 | 8/1973 | Kalwaites | 19/161 P |
| 3,768,118 | 10/1973 | Ruffo et al. | 19/156.3 |
| 3,774,272 | 11/1973 | Rubaschek et al. | 26/2 R |
| 3,811,131 | 5/1974 | Gamarra et al. | 2/243 |
| 3,842,468 | 10/1974 | Harrison | 28/2.4 |
| 3,862,291 | 1/1975 | Brandon, Jr. et al. | 264/321 |
| 3,875,975 | 4/1975 | Lee, Jr. | 139/291 |
| 3,880,201 | 4/1975 | Lee, Jr. et al. | 139/302 |
| 3,916,823 | 11/1975 | Halloran | 118/63 |
| 3,969,560 | 7/1976 | Lewis et al. | 428/90 |
| 3,969,779 | 7/1976 | Stewart, Jr. | 8/149 |
| 4,002,013 | 1/1977 | Johnson et al. | 57/22 |
| 4,059,880 | 11/1977 | Klein | 29/157 C |
| 4,274,182 | 6/1981 | Greenway | 26/2 R |
| 4,312,293 | 1/1982 | Hakim | 118/697 |
| 4,323,760 | 4/1982 | Greenway et al. | 219/364 |
| 4,329,389 | 5/1982 | Kimbrell, Jr. | 428/265 X |
| 4,332,063 | 6/1982 | Ehrhardt | 26/3 |
| 4,335,178 | 6/1982 | Fearing | 428/253 |
| 4,336,289 | 6/1982 | Davis | 428/89 X |
| 4,364,156 | 12/1982 | Greenway et al. | 26/2 R |
| 4,393,562 | 7/1983 | Stokes | 26/2 R |
| 4,418,451 | 12/1983 | Crenshaw | 26/2 R |
| 4,433,018 | 2/1984 | Tesch | 428/89 |
| 4,444,831 | 4/1984 | Leitner | 428/262 |
| 4,471,514 | 9/1984 | Stokes | 26/2 R |
| 4,499,637 | 2/1985 | Greenway | 26/2 R |
| 4,670,317 | 6/1987 | Greenway | 428/89 |
| 4,772,499 | 9/1988 | Greenway | 428/43 |
| 4,774,110 | 9/1988 | Murakami et al. | 427/365 |
| 4,798,748 | 1/1989 | Kitamura et al. | 428/89 X |
| 5,066,307 | 11/1991 | Lees et al. | 8/182 |

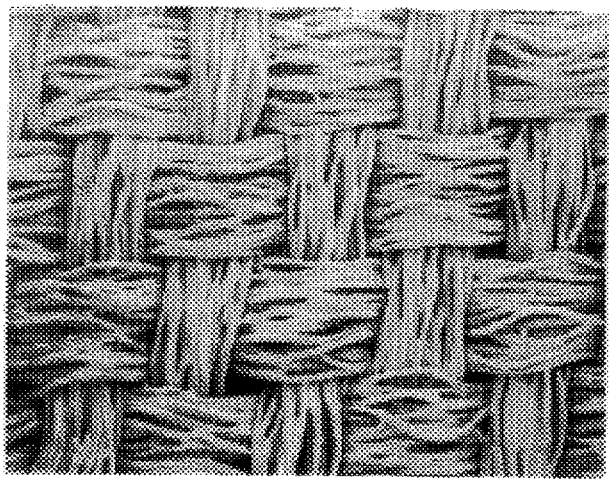
FIG. —5—
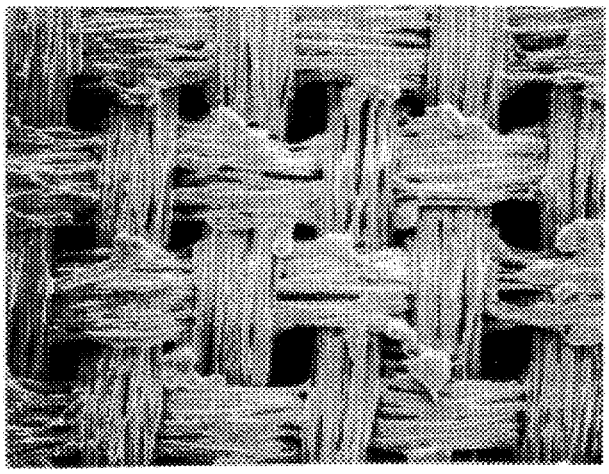
FIG. —6—
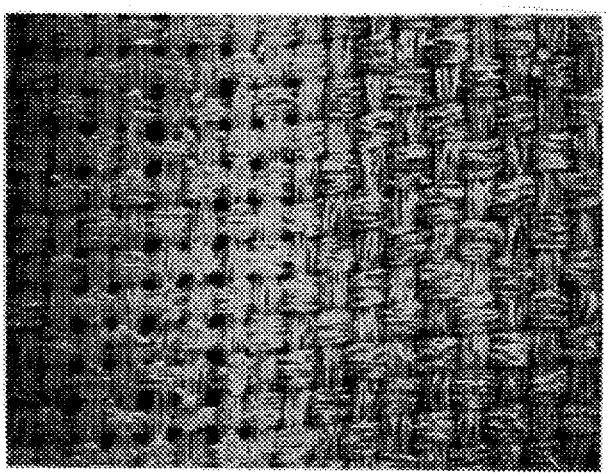
FIG. —7—

TEXTILE FABRIC HAVING A THERMALLY MODIFIED NARROW CHANNEL TO FACILITATE SEPARATION

This application is a continuation of prior application Ser. No. 08/512,610, filed on Aug. 8, 1995, now abandoned of Francis William Marco, Colman Barrett O'Connell, Howard Christy Willauer, Jr., and James Ansel Jacobs, Jr. for TEXTILE FABRIC HAVING A THERMALLY MODIFIED NARROW CHANNEL TO FACILITATE SEPARATION, which was a file wrapper continuation of abandoned application Ser. No. 08/189,275, filed on Jan. 31, 1994, which was a file wrapper continuation of abandoned application Ser. No. 07/998,262, filed on Dec. 29, 1992, which was a divisional of application Ser. No. 07/550,428, filed on Jul. 10 1990, issued as U.S. Pat. No. 5,202,077 on Apr. 13, 1993.

This invention relates to improved method and apparatus for removal of relatively moving substrate materials by means of a heated pressurized fluid stream and the novel products produced thereby, more particularly, to provide a structurally weakened recess in a thermally modifiable substrate such as a textile fabric containing the thermoplastic yarn or other fiber components, including, but not limited, to rayon, nylon, polyester, polypropylene, acetate, wool, nomex, and polypyrrole treated quartz fabric. It is foreseen that materials not included in the above list can be shown to be capable of thermally melting so that the above list should not be considered exhaustive. The textile fabric is intended to include all types of continuous or discontinuous webs or sheets containing fiber or yarn components, such as knitted, woven, tufted, flocked, laminated, or non-woven fabric constructions. Furthermore, it is foreseen that other substrates which are not usually considered textile fabrics, such as foam substrates, may be used advantageously, and are considered as a textile material for use in connection with this invention. As used herein, the term "fluid" includes gaseous, liquid, and solid fluent materials that may be directed in a cohesive pressurized stream or streams against the surface of substrate material. The term "substrate" is intended to define any material, the surface of which may be contacted by a pressurized stream or streams of fluid to melt, remove and weaken material. The apparatus is configured and arranged to melt and remove textile material thereby facilitating the separation of textile material by allowing the textile to be pulled apart at these structurally weakened recesses. The textile material is then treated by a mixture of an acrylic melanie resin and a acrylic polymer which hardens and stiffens the material and prevents jagged or frayed ends resulting from the separation of the textile material and thereby creates a solid fabric edge.

BACKGROUND OF THE INVENTION

Various apparatus have been proposed for directing heated pressurized fluid streams, such as air, onto the surface of moving textile fabrics. However, this has been for the purpose of altering the location of or modifying the thermal properties of fibers or yarns and provide a pattern or visual and tactile surface change in such fabrics. Examples of prior art equipment and methods of application of the pressurized fluid streams to a relatively moving material are disclosed in the following U.S. Pat. Nos. 2,110,118; 2,241,222; 2,563,259; 3,010,179; 3,403,862; 3,434,188; 3,585,098; 3,613,186. This prior art does not hint or suggest as to the removal and weakening of textile material. It is merely used to direct pressurized air or steam into the surface of textile fabrics to alter the location of or modify the thermal properties of fibers or yarns therein to provide a change in the surface appearance of such fabrics. Examples of this include U.S. Pat. No. 3,010,179 which discloses an apparatus for treating synthetic pile fabrics by directing a plurality of jets of dry steam from headers onto the face of the moving fabric to deflect and deorient the pile fibers in areas contacted by the steam, and the fabric is thereafter dried and heated to heat-set the deflected fibers and provide a visual effect simulating fur pelts. U.S. Pat. No. 2,563,259 discloses a method of patterning a flocked pile fabric by directing plural streams of air into the flocked surface of the fabric, before final curing of the adhesive in which the fibers are embedded, to reorient the pile fibers and produce certain patterns therein. U.S. Pat. No. 3,585,098 discloses apparatus for hot air or dry stream treatment of the pile surface of a fabric to relax stresses in the synthetic fibers throughout the fabric. U.S. Pat. No. 2,241,222 discloses apparatus having a plurality of jet orifices for directing pressurized air or steam perpendicularly into a fluffy fabric surface to raise and curl the nap or fluff of the fabric. U.S. Pat. No. 2,110,118 discloses a manifold having a narrow slot for directing pressurized air against the surface of a fabric containing groups of tufts during a textile treating operation. In fact, if the prior art devices removed or structurally weakened material, it would be counter to the purposes of the these devices which is to provide a visual and tactile surface change only. Any structural weakness created in the textile would be considered a defect. It is believed that such prior art treatment devices, as described in the aforementioned patents, are only capable of producing patterns of surface modifications of a random, non-defined nature in the textile in a manner that does not weaken the substrate.

SUMMARY OF THE INVENTION

It is therefore an object of the present invention to provide an improved method and apparatus for melting and removing portions of a substrate by applying discrete streams of pressurized heated fluid.

It is a further object of the invention to create a channeled recess in textile fabric thereby facilitating the separation of the fabric at said recess.

It is a more specific object to chemically treat the fabric so that when the fabric is separated at the point of fabric melting and removal, the resulting fabric edges are not jagged or frayed.

It is another object to provide certain novel fabric products produced by the method and apparatus of the present invention.

BRIEF DESCRIPTION OF THE DRAWINGS

The above as well as other objects of the invention will become more apparent from the following detailed description of the preferred embodiments of the invention, which when taken together with the accompanying drawings, in which:

FIG. 5 is a photograph of a woven textile fabric prior to treatment by means of the apparatus and methods of the present invention;

FIG. 6 is a photograph of a woven textile fabric after treatment by means of the apparatus and methods of the present invention; and FIG. 7 is a photograph of a woven textile fabric in which the right half of the photograph is treated by means of the apparatus and methods of the present invention involving the heated pressurized fluid stream treatment while the textile fabric in the left half of the photograph remains untreated.

DETAILED DESCRIPTION OF THE PREFERRED EMBODIMENT

Figure 1:
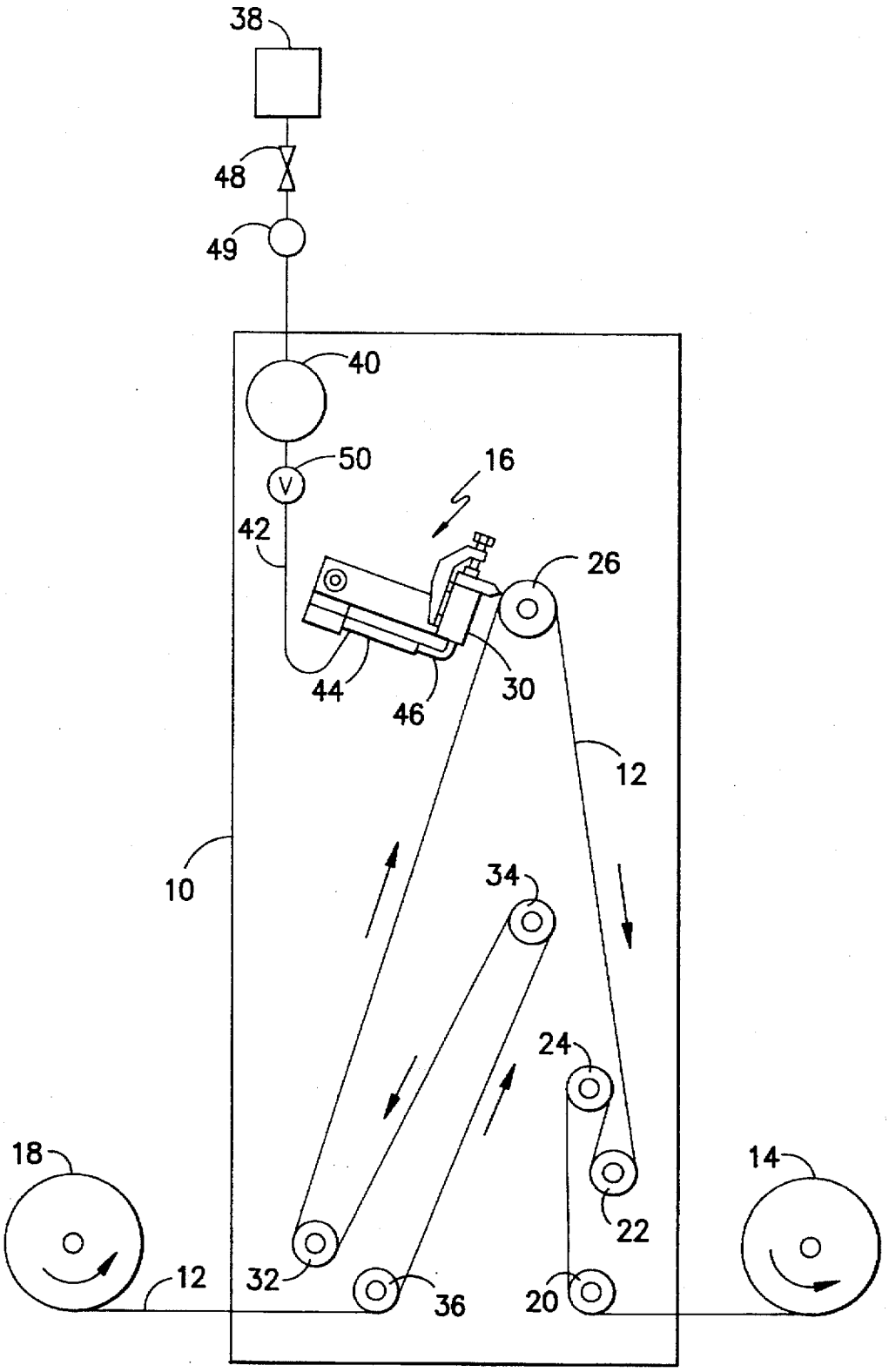
FIG. 1 is a schematic side elevation view of apparatus for heated pressurized fluid stream treatment of a moving substrate material to melt, remove and weaken textile fabric, and incorporating novel features of the present invention.

Referring more specifically to the drawings, FIG. 1 shows, diagrammatically, an overall side elevation view of apparatus for heated pressurized fluid stream treatment of a moving substrate material to melt and remove material to create a recess in the moving substrate. As seen, the apparatus includes a main support frame including end frame support members 10, one of which is illustrated in FIG.1. Suitably rotatably mounted on the end support members of the frame 10 are a plurality of substrate guide rolls which direct an indefinite length of substrate material, such as a textile fabric 12, from a fabric supply roll 18, past a pressurized heated fluid treating unit, generally indicated at 16. After treatment, the fabric is collected in a continuous manner on a take-up roll 14. As shown, fabric 12 from supply roll 18 passes over an idler roll 36 and is fed by a pair of driven rolls 32, 34 to a main driven fabric support roll 26. The surface of the fabric passes closely adjacent to the heated fluid discharge outlet of an elongate fluid distributing manifold assembly 30 of treating unit 16. The treated fabric 12 thereafter passes over a series of driven rolls 22, 24 and an idler roll 20 to take up roll 14 for collection.

Figure 2:
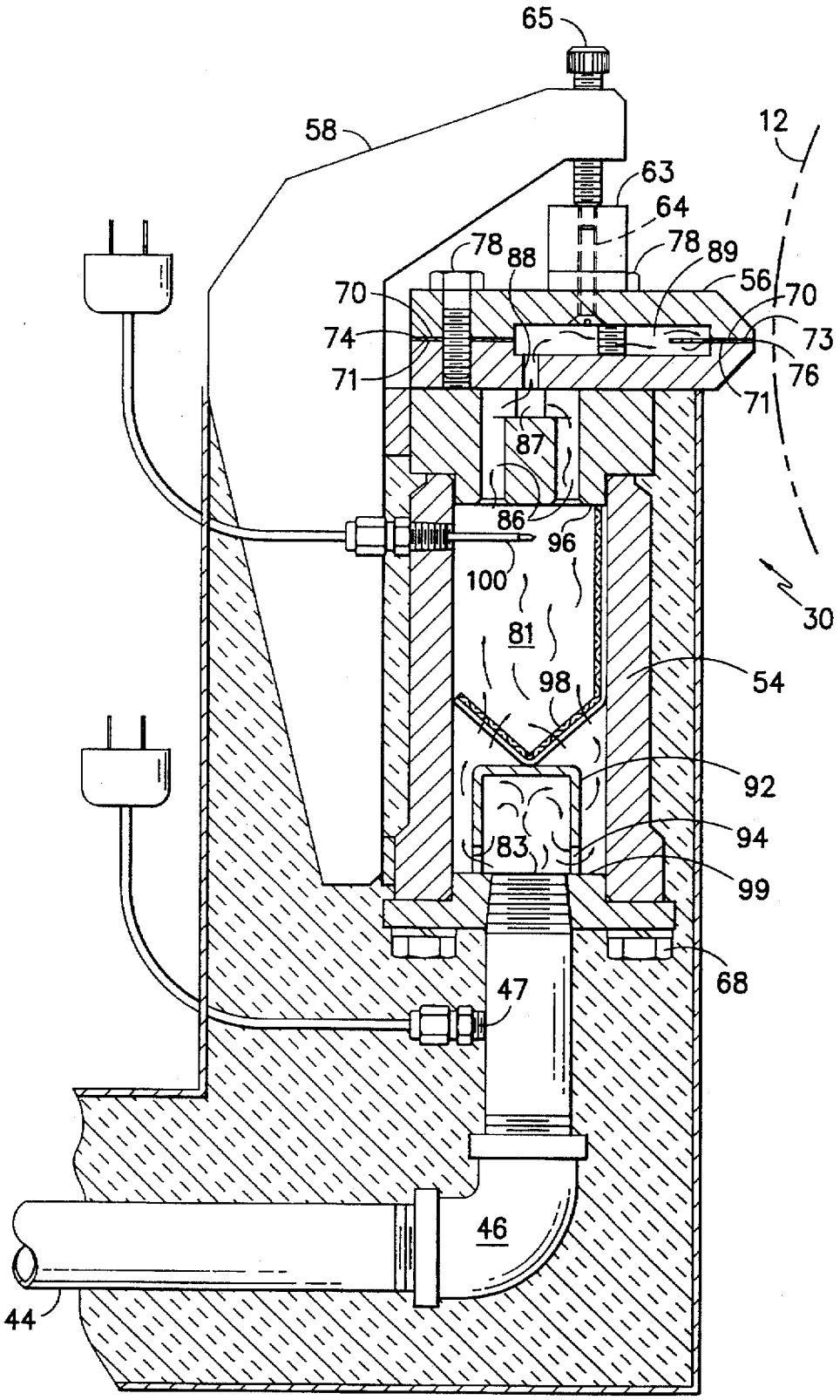
FIG. 2 is an partial sectional elevation view of the fluid distributing manifold assembly of the apparatus of FIG. 1 taken along line 2—2 of FIG. 4.

As illustrated in FIG. 1, fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of heated fluid distributing manifold assembly 30 and supply heated pressurized air thereto through short, individual air supply lines, indicated at 46, which communicate with assembly 30 uniformly along its full length. Air supplied to the heated fluid distributing manifold assembly 30 is controlled by a master control valve 48, pressure regulator valve 49, and individual precision control valves, such as needle valves 50, located in each heater air supply line 42. The heaters 44 are controlled in suitable manner, as by temperature sensing means 47 located in the outlet lines 46 of each heater as shown in FIG. 2. A single temperature sensing means 47 can be used as a representative sample for the entire bank of individual heaters. Although economical, the use of one temperature sensing means results in less accuracy. The regulation of air flow and electrical power to each of the heaters maintains the heated fluid at a uniform temperature and pressure as it passes into the manifold assembly along its full length.

Typically, for melting and removing textile fabric, the heaters are employed to heat air exiting the heaters and entering the manifold assembly to a uniform temperature of about 500° Fahrenheit to 900° Fahrenheit. However, the range of temperature for fabric treated with this apparatus may be between about 350° Fahrenheit to about 1000° Fahrenheit or more. The preferred operating temperature for any given substrate depends upon: the components of the substrate, the construction of the substrate, the desired amount of material removal, the speed of transport of the substrate, the pressure of the heated fluid, the tension of the substrate, the proximity of the substrate to the treating manifold, and others.

The heated fluid distributing manifold assembly 30 is disposed across the full width of the path of movement of the fabric and closely adjacent the surface thereof to be treated. Although the length of the manifold assembly may vary, typically in the treatment of textile fabric materials, the length of the manifold assembly may be 76 inches or more to accommodate fabrics of up to about 72 inches in width.

Details of the heated fluid distributing manifold assembly 30 may be best described by reference to FIGS. 2–4 of the drawings. As seen in FIG. 2, which is a partial sectional elevation view through the assembly, manifold assembly 30 comprises a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the fabric 12 adjacent its path of movement.

As best seen in FIG. 2, first elongate manifold housing 54 is of generally rectangular cross-sectional shape, and includes a first elongate fluid receiving compartment 81, the ends of which are sealed by end wall plates 99 suitably connected by means of bolts 68. The temperature of the first elongate fluid receiving compartment 81 is monitored by thermocouple 100 whose input controls the associated needle valve 50 in order to maintain uniform melting and removing of material 12 across the entire substrate width. The control of this process can be accomplished by any of a wide variety of electronic computer control systems which use data storage means such as magnetic tape, EPROMS, and so forth. Communicating with bottom wall plate 99 through fluid inlet openings, one of which, 83, is shown in FIG. 2, and spaced approximately uniformly therealong are the air supply lines 46 from each of the electrical heaters 44.

The manifold housings 54, 56 are constructed and arranged so that the flow path of fluid through the first housing 54 is generally at a right angle to the discharge axes of the fluid stream outlets of the second manifold housing 56.

Figure 3:
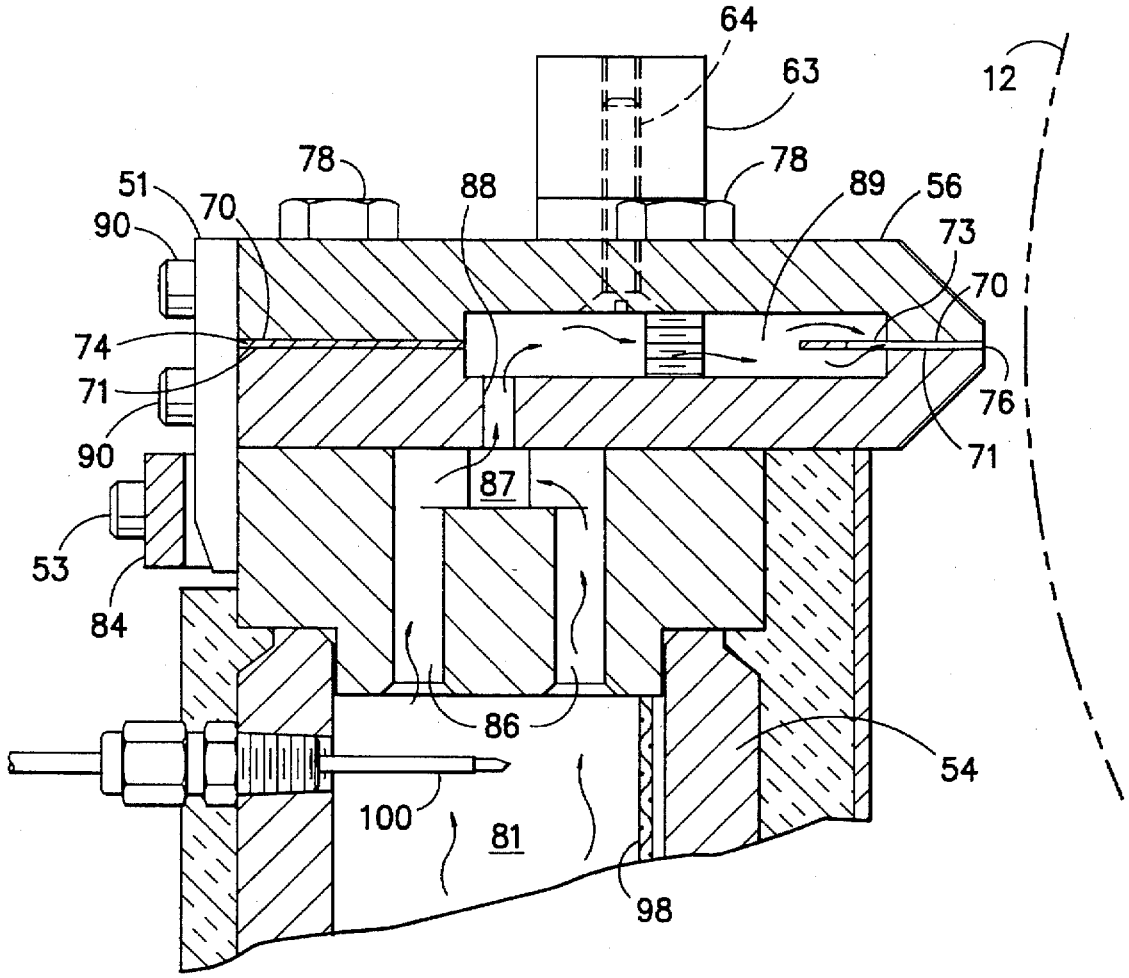
FIG. 3 is an enlarged broken away sectional view of the fluid stream distributing manifold housing of the manifold assembly as illustrated in FIG. 2 taken along line 3—3 of FIG. 4.
Figure 4:
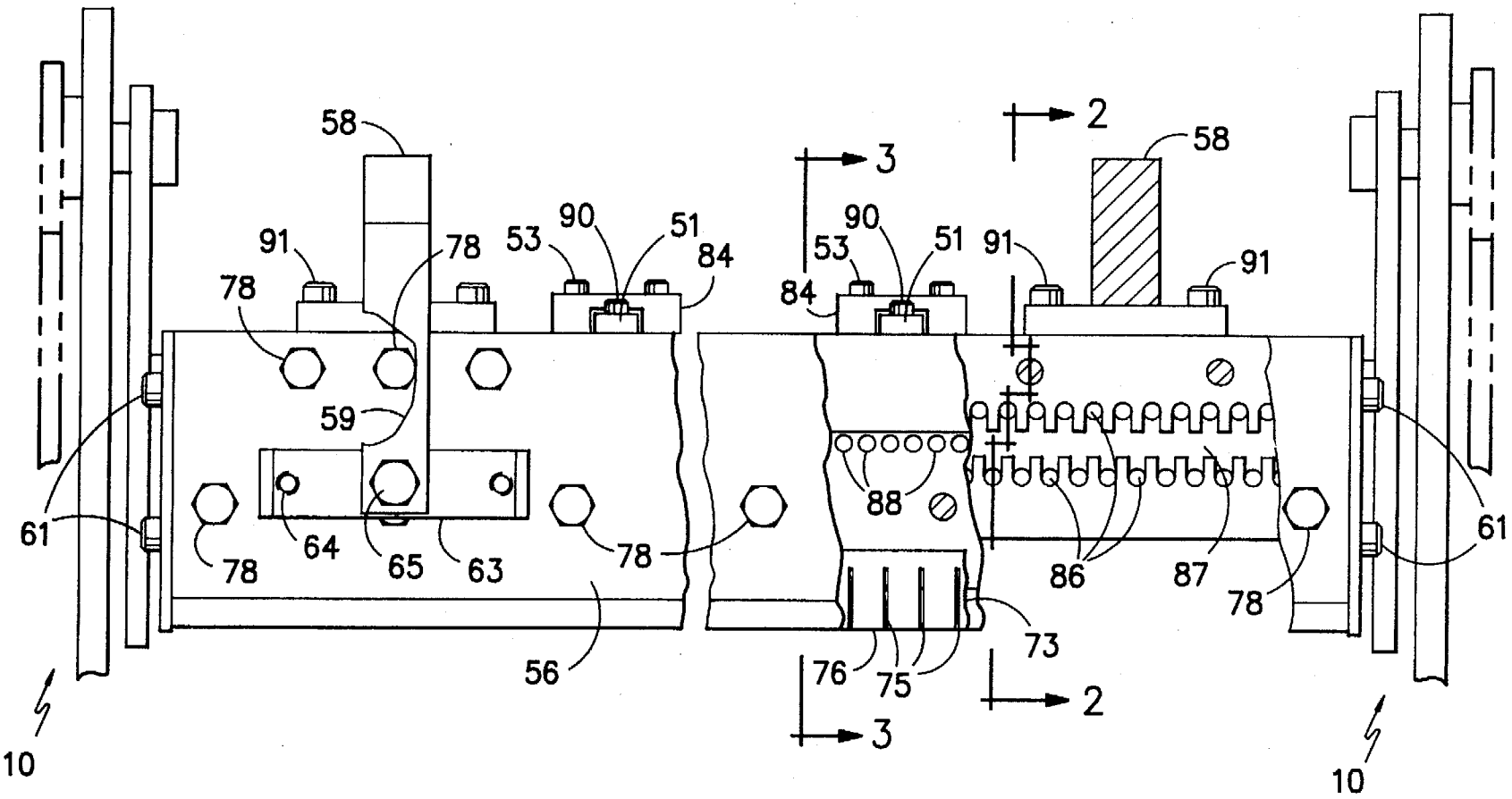
FIG. 4 is a top plan fragmentary view of the fluid distributing manifold housing of the apparatus of FIG. 2.

As best seen in FIGS. 2, 3 and 4, manifold housing 54 is provided with a plurality of fluid flow passageways 86 which are disposed in uniformly spaced relation along the plate in two offset rows with an indented channel 87 connecting them. The fluid then flows through a solitary fluid flow passageway 88 positioned between said two offset fluid flow passageways 86 that connect to the fluid receiving compartment 89 within the second smaller elongate manifold housing 56.

Baffle plate 92 serves to define a fluid receiving chamber in the compartment 81 having side openings or slots 94 to direct the incoming heated air from the bank of heaters in a generally reversing path of flow through compartment 81. There is another v-shaped baffle means 98 that is attached to the upper wall 96 of compartment 81 extending downward with the bottom of the v-shaped configuration adjacent to the top of baffle plate 92.

The opposed wall members 70, 71 are maintained in spaced relation by an elongate front shim plate 73 which has a plurality of parallel, elongate outlet channels 75, as shown in FIG. 4, in one side edge thereof, and a rear elongate shim plate 74 disposed between the opposed faces of the wall members 70, 71 in fluid tight engagement therewith. The rear elongate shim plate 74 is held in position by an elongate bar 51 which, as shown in FIGS. 3 and 4, is secured to the first elongate manifold housing 54 and the second elongate manifold housing 56 by conventional bolts 90 parallel to wall members 70 and 71. The bottom of elongate plate 51 is held in position by a u-shaped clamping means 84 that encloses the elongate plate 51. The u-shaped clamping means 84 holds the elongate bar in position and is attached by two parallel bolts to the first elongate housing 54. As seen in FIG. 4, the notched edge 76 of shim plate 73 is disposed between the first and second wall members 70, 71 along the front elongate edge portions thereof to form a plurality of parallel heated fluid discharge outlet channels 75 which direct heated pressurized air from the fluid receiving compartment 89, within the smaller elongate manifold housing 56, in narrow, discrete streams at a substantially right angle into the surface of the moving fabric substrate material 12. Typically, in the treatment of textile fabrics such as pile fabrics the discharge outlet channels 75 of manifold 56 may be 0.010 inches to about 6 inches and greater in width with the optimal range being 0.010 to 0.125 inches. The thickness of the front shim plate 73 should range between 0.015 to 0.125 inches with the optimal value being 0.065 inches. For precise control of the heated air streams striking the fabric, the discharge outlet channels are preferably maintained between about 0.010 to 0.125 inches from the fabric surface being treated with the optimal range being 0.020 to 0.060 inches. However, this distance from the face of the fabric can be as much as 0.200 inches or more and still produce a significant recess to facilitate separation depending on the substrate and other constraints. The fabric thickness can range from 0.002 to 0.250 inches.

Wall members 70, 71 of the second manifold housing 56 are connected at spaced locations by a plurality of threaded bolts 78, and the second manifold housing 56 is maintained in fluid tight relation with its shim members and with the elongate channel 87 of the first manifold housing 54, by the adjustable clamp 58. The adjustable clamp 58, as shown in FIGS. 2 and 4, has a u-shaped notch 59 which provides access to threaded bolt 78. The adjustable clamp 58 applies pressure to a bridge 63 by means of a standard machine screw 65. The adjustable clamp 58 is attached to the first manifold housing 54 by means of standard bolts 91 as shown in FIG. 4. The bridge 63 is attached to the top of the second manifold housing 56 by means of two standard flat head machine screws 64 that are inserted upward through the second manifold housing 56 prior to assembly as shown in FIGS. 2, 3 and 4.

The fluid distributing manifold assembly 30 is attached to the end frame support members 10, as shown in FIG. 4, by conventional bolts 61.

In order to prevent frayed and jagged edges on the substrate materials after the separation process, the substrate materials are treated by a combination of acrylic melamine resin and acrylic polymer. This provides for a hardened finished edge for the substrate material due to the chemical reaction that solidifies the chemical solution. The acrylic melamine resin can be found under the trademark AEROTEX M-3 manufactured by American Cyanamid Corporation. The percentage of acrylic melamine resin in the solution should range from 5 to 12 percent of the formula. The acrylic polymer can be found under the trademark POLYCRYL 7F-7 manufactured by Morton Chemical Company. The percentage of acrylic polymer in the solution should optionally range from 10 to 20 percent of the solution. The remainder of the solution should consist of water or a similar aqueous-like solution with ammonium hydroxide ($NH_4OH$) solution to achieve a pH of 8.0. The means of chemically treating a textile substrate by dipping the substrate material in a chemical bath, rolling out the substrate material to remove the excess chemical solution with the substrate acquiring a 75 percent weight increase, stretching out the substrate material on a tenter frame at a rate of twenty yards per minute and curing the textile is well known in the art as described in U.S. Pat. No. 4,329,389 which is incorporated herein by reference. It is believed that the treatment of the substrate material by the chemical solution in the above process can occur either before or after the process of melting and removing the substrate material by means of a heated pressurized fluid stream. The curing process should be performed at an optimal range of between 365° to about 410° Fahrenheit.

The use of the apparatus of the present invention to carry out the process described and claimed herein may be further understood by the following specific example setting forth operating conditions. The Example is by way of illustration only, and is not intended to be limiting on the use of the apparatus of the present invention.

EXAMPLE 1

A polyester fabric, as shown in FIG. 5, having a weight of 2.14 ounces per square yard and a height of 0.005 inches was continuously fed through the apparatus illustrated in FIG. 1 at a speed of 12 yards per minute. The temperature and pressure of the heated air in the discharge manifold compartment was maintained at 860° F. and 4 p.s.i., respectively. The discharge slot of the manifold was maintained at a distance of approximately 0.100 inches from the fabric surface. The spaced discharged channels formed in the slot were of rectangular cross-sectional dimension of 0.03 inches by 0.065 inches. The length of each channel through the slot was 0.625 inches and the channels were spaced on 0.125 inch centers across the manifold.

The heated streams of gas striking the surface of the fabric melts the fabric and thereby creates a channeled recess in the fabric. This provides a structural weakness in the fabric and facilitates the separation of the fabric along this recess when tension is applied to the fabric. This recess is illustrated in FIG. 6 of the drawings.

The fabric is then dipped in a chemical bath consisting of 6 percent acrylic melamine resin and 15 percent acrylic polymer and 79 percent water with ammonium hydroxide added to give the solution a pH of 8.0. The fabric is then rolled out and then stretched on a tenter frame at a rate of 20 yards per minute while simultaneously being cured at a temperature of 375° Fahrenheit. This chemical treatment provides for a clean hard edge with no jagged or frayed edges upon fabric separation.

FIG. 7 of the drawings displays the nonmelted fabric on the right side of the photograph with the melted recess on the left side of the photograph.

Although this Example sets forth typical operating conditions, it can be appreciated that the parameters can be altered considerably depending on the substrate, temperature, fluid, speed, discharge channel size, and so forth.

Therefore, it is not intended that the scope of the invention be limited to the specific embodiment illustrated and described. Rather, it is intended that the scope of the invention be defined by the appended claims and their equivalents.

What is claimed is:

1. A textile fabric comprising thermoplastic yarns, having a narrow channel in said textile fabric formed by melting and removing said thermoplastic yarns through exposure to discrete streams of pressured heated air, thereby weakening said fabric at said narrow channel, and said textile fabric is treated with a mixture of acrylic melamine resin, acrylic polymer and aqueous media that provides a hardened finish to said textile fabric so that said textile fabric is capable of being pulled apart at said narrow channel without jagged or frayed edges.

* * * * *